US009038347B2

(12) United States Patent
Gundersen

(10) Patent No.: US 9,038,347 B2
(45) Date of Patent: May 26, 2015

(54) TRUSS AND COLUMN STRUCTURES INCORPORATING NATURAL ROUND TIMBERS AND NATURAL BRANCHED ROUND TIMBERS

(71) Applicant: Whole Trees, LLC, Madison, WI (US)

(72) Inventor: Roald Gundersen, Madison, WI (US)

(73) Assignee: Whole Trees, LLC, Madison, WI (US)

( * ) Notice: Subject to any disclaimer, the term of this patent is extended or adjusted under 35 U.S.C. 154(b) by 0 days.

(21) Appl. No.: 14/136,253

(22) Filed: Dec. 20, 2013

(65) Prior Publication Data

US 2014/0174017 A1 Jun. 26, 2014

Related U.S. Application Data

(60) Provisional application No. 61/745,761, filed on Dec. 24, 2012.

(51) Int. Cl.

| | |
|---|---|
| ***E04B 1/30*** | (2006.01) |
| ***E04C 3/12*** | (2006.01) |
| ***E04C 3/292*** | (2006.01) |
| ***E04C 3/42*** | (2006.01) |
| ***E04C 3/46*** | (2006.01) |
| ***E04C 5/16*** | (2006.01) |
| ***E04B 2/70*** | (2006.01) |
| *E04B 1/26* | (2006.01) |

(52) U.S. Cl.

CPC . *E04B 1/30* (2013.01); *E04C 3/127* (2013.01); *E04C 3/292* (2013.01); *E04C 3/42* (2013.01); *E04C 3/46* (2013.01); *E04C 5/162* (2013.01); *E04B 2001/2648* (2013.01); *E04B 1/26* (2013.01); *E04B 2001/2668* (2013.01); *E04B 2/705* (2013.01)

(58) Field of Classification Search

CPC ... E04B 1/26; E04B 2/705; E04B 2001/2668; E04B 2001/2648; E04B 1/30; E04C 3/292; E04C 5/162; E04C 3/127; E04C 3/42; E04C 3/46; E04H 12/04

USPC ..... 52/636, 690, 693, 633, 634, 836, 848, 52/854, 233

See application file for complete search history.

(56) References Cited

U.S. PATENT DOCUMENTS

| | | | | |
|---|---|---|---|---|
| 2,844,643 | A * | 7/1958 | Cofer et al. | 174/6 |
| 3,268,251 | A * | 8/1966 | Troutner | 52/693 |
| 3,531,904 | A * | 10/1970 | Sanford | 52/696 |
| 3,537,224 | A * | 11/1970 | Troutner | 52/693 |

(Continued)

FOREIGN PATENT DOCUMENTS

| | | | | |
|---|---|---|---|---|
| DE | 3445745 | A1 * | 6/1986 | A63B 9/00 |
| DE | 102006019810 | A1 * | 10/2007 | |

(Continued)

OTHER PUBLICATIONS

International Search Report and Written Opinion issued in PCT/US2013/076974, Apr. 1, 2014.

(Continued)

*Primary Examiner* — Brent W Herring

(74) *Attorney, Agent, or Firm* — Bell & Manning, LLC

(57) ABSTRACT

Trusses comprising natural round timbers as top and bottom cords are provided. Also provided are truss and column assemblies comprising natural branched round timber columns connected to a truss.

5 Claims, 5 Drawing Sheets

(56) References Cited

U.S. PATENT DOCUMENTS

| | | | | | |
|---|---|---|---|---|---|
| 3,570,204 | A | * | 3/1971 | Birkemier | 52/289 |
| 3,591,995 | A | * | 7/1971 | Troutner | 52/693 |
| 3,702,050 | A | * | 11/1972 | Price | 52/693 |
| 3,778,946 | A | * | 12/1973 | Wood et al. | 52/223.8 |
| 3,857,218 | A | * | 12/1974 | Gilb | 52/694 |
| 4,056,902 | A | * | 11/1977 | Ziegler, Jr. | 52/73 |
| 4,069,635 | A | * | 1/1978 | Gilb | 52/693 |
| 4,104,843 | A | * | 8/1978 | Gilb | 52/693 |
| 4,173,857 | A | * | 11/1979 | Kosaka | 52/642 |
| 4,274,241 | A | | 6/1981 | Lindal | |
| 4,294,050 | A | | 10/1981 | Kandel | |
| 4,295,318 | A | * | 10/1981 | Perlman | 52/693 |
| 4,366,659 | A | * | 1/1983 | Jensen | 52/693 |
| 4,393,637 | A | * | 7/1983 | Mosier | 52/644 |
| 4,682,460 | A | * | 7/1987 | Reetz | 52/632 |
| 4,745,724 | A | * | 5/1988 | Reetz | 52/632 |
| 4,872,299 | A | * | 10/1989 | Troutner et al. | 52/693 |
| 5,522,186 | A | * | 6/1996 | Jarman | 52/73 |
| 5,644,888 | A | * | 7/1997 | Johnson | 52/651.01 |
| 5,658,099 | A | * | 8/1997 | Pienaar et al. | 405/288 |
| 5,954,447 | A | * | 9/1999 | Bathon | 403/267 |
| 6,173,550 | B1 | * | 1/2001 | Tingley | 52/837 |
| 6,363,672 | B1 | * | 4/2002 | Baker | 52/233 |
| 6,438,920 | B1 | | 8/2002 | Tobey | |
| 6,892,502 | B1 | * | 5/2005 | Hubbell et al. | 52/633 |
| D612,516 | S | * | 3/2010 | Stainton | D25/33 |
| 8,240,106 | B2 | * | 8/2012 | Cloyd et al. | 52/653.1 |
| 8,695,295 | B2 | * | 4/2014 | Thornton et al. | 52/233 |
| 2005/0269158 | A1 | * | 12/2005 | Fulton | 182/187 |
| 2007/0130875 | A1 | * | 6/2007 | Detal | 52/650.3 |
| 2008/0121312 | A1 | * | 5/2008 | Poutanen | 144/347 |
| 2009/0293373 | A1 | * | 12/2009 | Klinkhamer et al. | 52/79.9 |
| 2010/0043341 | A1 | * | 2/2010 | Staley | 52/702 |
| 2010/0051083 | A1 | * | 3/2010 | Boyk | 136/244 |
| 2011/0016824 | A1 | * | 1/2011 | Thornton et al. | 52/854 |

FOREIGN PATENT DOCUMENTS

| | | | | | |
|---|---|---|---|---|---|
| EP | 412910 | A1 | * | 2/1991 | B29C 33/36 |
| JP | 01290855 | A | * | 11/1989 | E04C 3/18 |

OTHER PUBLICATIONS

Branching columns installed in private residence, published before Dec. 24, 2011.

Dimensional lumber/natural timber truss hybrid installed in private residence, published before Dec. 24, 2011.

Whole Trees Case Study Brochure, published before Dec. 24, 2011.

Whole Trees Big Box Case Study Brochure, published before Dec. 24, 2011.

* cited by examiner

TRUSS AND COLUMN STRUCTURES INCORPORATING NATURAL ROUND TIMBERS AND NATURAL BRANCHED ROUND TIMBERS

CROSS-REFERENCE TO RELATED APPLICATION

This application claims priority from U.S. provisional patent application No. 61/745,761, filed on Dec. 24, 2012, the entire disclosure of which is incorporated herein by reference.

FIELD OF THE INVENTION

This invention relates generally to the field of heavy timber construction materials. More particularly, the present invention relates to trusses and truss and column structures, and related methods, that incorporate straight and branched natural round timbers to provide improved spanning and bracing with reduced consumption of energy and non-renewable materials compared to the prior art.

BACKGROUND OF THE INVENTION

Buildings, large and small, must span space and resist axial and lateral forces, for example, forces caused by gravity, snow, wind or earthquakes. In residential construction this is most often accomplished by a series of triangular trusses in the attic space and wall and roof sheathing. Flat roofed and multi-story commercial buildings typically carry loads with walls or columns, and span spaces with combinations of girders, beams, and joists which are often trusses. Lateral bracing is accomplished with combinations of three bracing methods: a moment-resisting frame, diaphragm shear walls and floors or diagonal bracing. Moment-resisting frames are achieved through theoretically rigid joints, such as a welded steel connection or a continuously poured concrete intersection of column and beam. Diaphragm bracing (or shear walls) are able to rigidly resist forces in any direction. Diagonal bracing can take the form of knee braces (at frame corners) or floor-to-floor cross bracing.

The commercial construction industry is currently dominated by steel and concrete structural systems which are structurally functional but demand high inputs of energy and non-renewing natural resources. Wood is a much more environmentally friendly construction material due to its lower energy requirements, low emissions and renewable nature. However, dimensional wood framing cannot meet many commercial fire code requirements, and create the moment-resisting frame bracing possible in steel and concrete structures.

This leaves diagonal bracing as the bracing method available for timber construction. Dimensional wood framing typically employs plywood shear panels to provide lateral bracing. Heavy timber structures typically employ knee bracing—additional diagonal members attached to form triangles at each connecting corner of the column and beam frame. This system is functional but cumbersome—each knee brace requires additional member preparations and the fabrication of additional connections.

What is needed is a branched timber system for heavy timber construction that provides integrated lateral bracing and spanning in a post and beam structural system suitable for large buildings, with simplified construction and reduced cost.

SUMMARY OF THE INVENTION

Trusses comprising natural round timbers as top and bottom cords are provided. Also provided are truss and column assemblies comprising natural branched round timber columns connected to a truss.

One embodiment of a truss comprises: a top cord comprising a first natural round timber; a bottom cord comprising a second natural round timber, the first natural round timber and the second natural round timber being disposed in a substantially parallel arrangement; and a webbing structure comprising a plurality of web members, the web members connecting the first natural round timber and the second natural round timber.

One embodiment of a truss and column assembly comprises: a first column; a second column; and a truss connecting the first and second columns. The truss comprises: a top cord comprising a first natural round timber; a bottom cord comprising a second natural round timber, the first natural round timber and the second natural round timber being disposed in a substantially parallel arrangement; and a webbing structure comprising a plurality of web members, the web members connecting the first natural round timber and the second natural round timber.

In some embodiments of the truss and column assemblies, the first column comprises a first natural branched round timber having a trunk, a first branch and a second branch, the first and second branches being connected at a crook; the second column comprises a second natural branched round timber having a trunk, a first branch and a second branch, the first and second branches being connected at a crook. In these embodiments, the first natural round timber is connected to a branch of the first natural branched round timber and a branch of the second natural branched round timber; and the second natural round timber is connected to a branch of the first natural branched round timber and a branch of the second natural branched round timber.

Further objects, features, and advantages of the invention will be apparent from the following detailed description when taken in conjunction with the accompanying drawings.

DETAILED DESCRIPTION OF THE INVENTION

Trusses comprising natural round timbers as top and bottom cords are provided. Also provided are truss and column assemblies comprising natural branched round timber columns connected to a truss. The truss and column assemblies can provide improved strength in spanning and lateral bracing and improved durability, relative to truss and column assemblies that use milled lumber, rather than natural round timber.

The use of natural round timbers in the present trusses and assemblies is advantageous because they are stronger than lumber, and are a relatively fast renewing resource that may be sourced locally from forest cullings that are typically viewed by the forest industry as waste or low-value products. As a result, natural round timber trusses and truss and column assemblies have the potential to improve strength and durability, while reducing the energy, pollution and waste required for processing the materials used to fabricate building structures.

For the purposes of this disclosure, the phrase "natural round timbers" refers to trees retaining their natural round cross-sections and the inherent natural taper along their longitudinal axis (i.e., along the length of the timber). The present natural round timbers can also be referred to as round wood logs. The natural round timbers may be branched, that is they may retain one or more of their branches. Unlike lumber, natural round timbers retain the densest and strongest portions of their wood, which forms toward their perimeters as they mature in uniformly-aged, and increasingly dense, conifer stands. As a result, natural round timbers can be 50% stronger in bending than equivalent-sized milled timbers. The wood fibers at the perimeter of natural round timber, which are the first to be milled away in the production of lumber, are also grown in tension, which increases a natural round timber's ability to span spaces and resist lateral loads in buildings. As a result, a piece of lumber will typically have less than a third of the bending strength of the natural round timber from which it is milled.

Natural branched round timbers, also referred to as branched natural timbers, are similarly stronger than their lumber counter-parts. In fact, the branched crook of a natural branched round timber provides a very strong natural rigid wooden connection, stronger even than the branches that it connects. In contrast, man-made joints between pieces of milled timber, such as mitered joints and knee braces, are generally the weakest point of an assembly constructed with such joints.

Figure 1:
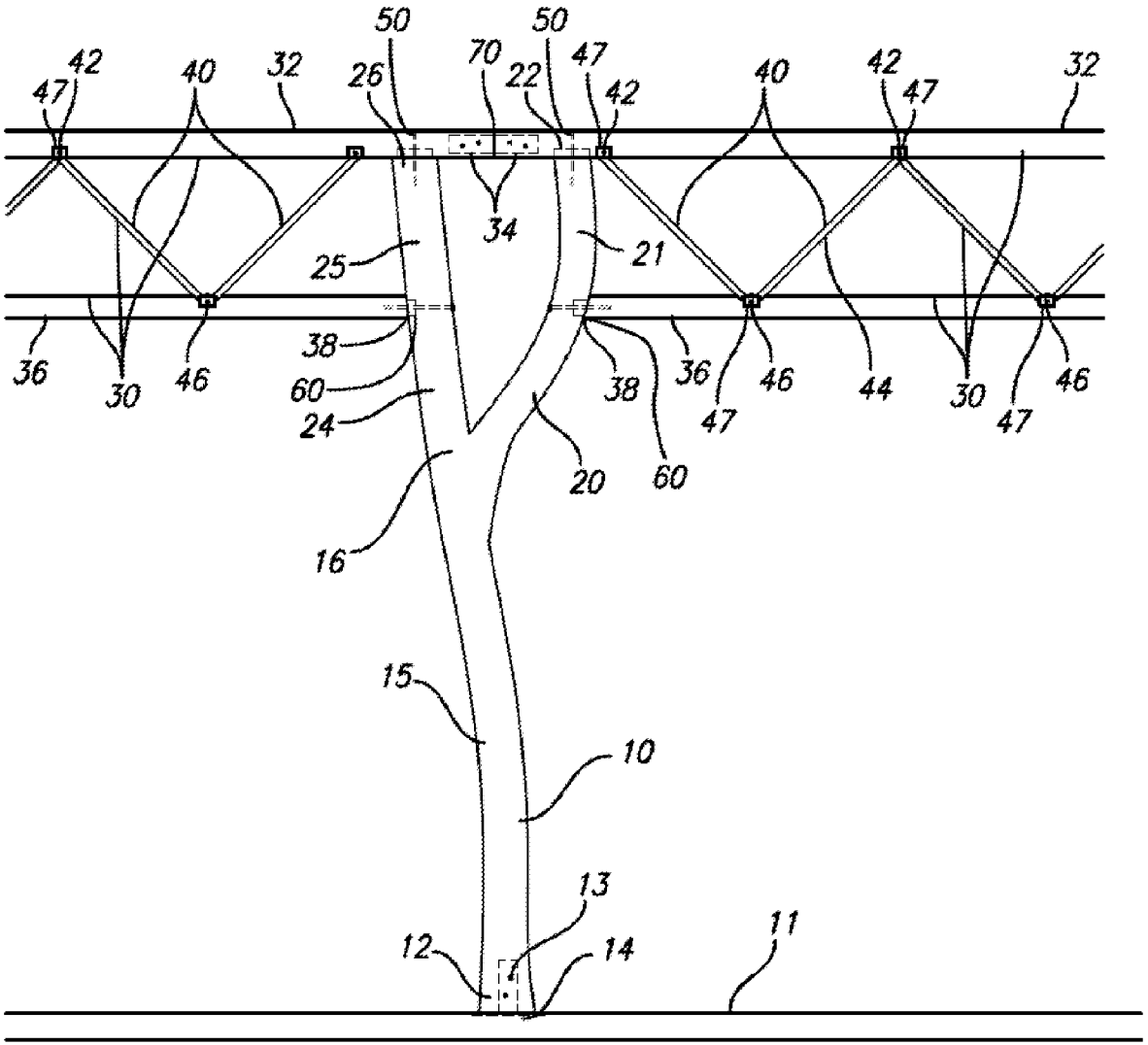
FIG. 1 depicts a side view of an exemplary truss and column assembly with natural branched round timber columns.

As perhaps best shown in FIG. 1, a truss and column assembly made with natural branched round timber columns includes a natural branched round timber 10 with a trunk 15 extending from a base 12 to a crook 16. The natural branched round timber 10 includes a plurality of branches, for example a first branch 20 and a second branch 24. The base 12 may rest upon a foundation 11. A base-foundation connection 13 may be used to secure the base 12 to the foundation 11, using any suitable fastener, for example, using one or more of steel angles, bolts, screws, spikes, and nails. While FIG. 1 shows only a single column in the assembly, two or more columns can be used, with two being a preferred number of columns.

A truss and column assembly made with natural branched round timber further includes a webbed truss 30 with a top cord 32 and a bottom cord 36 connected together by a web 40. The web 40 may be formed of a web member 44 extending between a web top limit 42 at the top cord 32 and a web bottom limit 46 at the bottom cord 36. In this embodiment, the web member 44 is formed from a plurality of sections of steel section stock, such as C-channel or L-channel stock. The sections can comprise web tabs 48 disposed at their ends, the web tabs having a hole sized for a suitable fastener, such as a nail, screw or bolt.

The top cord 32 is a relatively straight and low-taper natural round timber. Top cord 32 can be formed as a unitary structure, or of multiple pieces, each piece comprising a natural round timber. In this embodiment, the top cord 32 is formed of at least two pieces, each having a top cord end 34. The top cord ends 34 of the natural round timbers can be fastened together using a cord-cord connection 70. The cord-cord connection 70 is preferably located between the first branch end 22 and the second branch end 26. The top cord 32 is fastened to the first branch end 22 and second branch end 26 by a top-cord-to-branch-connection 50. By locating cord-cord connection 70 between the branch ends, the span between cord-to-branch-connections 50 in neighboring columns along the truss is reduced relative to span between the cord-to-column-connections of a truss having the same design that uses unbranched columns. As a result, the spanning capacities of the present trusses are improved. In addition, the triangulated shape formed by the two top-cord-to-branch-connections 55 and crook 16 distribute axial, shear, and lateral loads to two points, thereby increasing the load bearing capacities of the present trusses relative to those of trusses having the same design that use unbranched columns, which distribute the loads to a single point. This triangulated assembly also provides lateral strength along its length.

By way of illustration, while spans between cord-to-branch connections having a variety of lengths could be used in the column-truss assembly, in some embodiments, the lengths of the spans are in the range from about 10 to 50 feet (10' to 50'). This includes embodiments in which the spans have lengths in the range from about 10' to 20' and also includes embodiments in which the spans have lengths the range from about 20'-50'. Similarly, while a variety of column heights could be used, typical column heights are in the range from about 8' to 30'. This includes embodiments in which the column heights are in the range from about 10' to 30' and also includes embodiment in which the column heights are in the range from about 16'-24'.

Like top cord 32, bottom cord 36 is a relatively straight and low-taper natural round timber. Bottom cord 36 has a bottom cord end 38 secured to the natural branched round timber 10 using a bottom-cord-to-timber-connection 60. The bottom-cord-to-timber-connection 60 may be made at a point above the crook 16, in other words, on one of the first branch 20 or second branch 24. Alternatively, the bottom-cord-to-timber-connection 60 can be made at a point below the crook 16, in other words, on the trunk 15.

The geometry of the natural branched round timber 10 can be characterized by several reference points and dimensions, including its height, base center 14, geometric crook center 18, and effective crook center 19. The first branch 20 terminates in a first branch end 22 and includes a first branch inter-cord section 21 between the top cord 32 and the bottom cord 36. The second branch 24 terminates in a second branch end 26 and includes a second branch inter-cord section 25 between the top cord 32 and the bottom cord 36. The midpoint between the first branch end 22 and the second branch end 26 is a geometric branch center 28, which may differ from the effective branch center 29.

Figure 2:
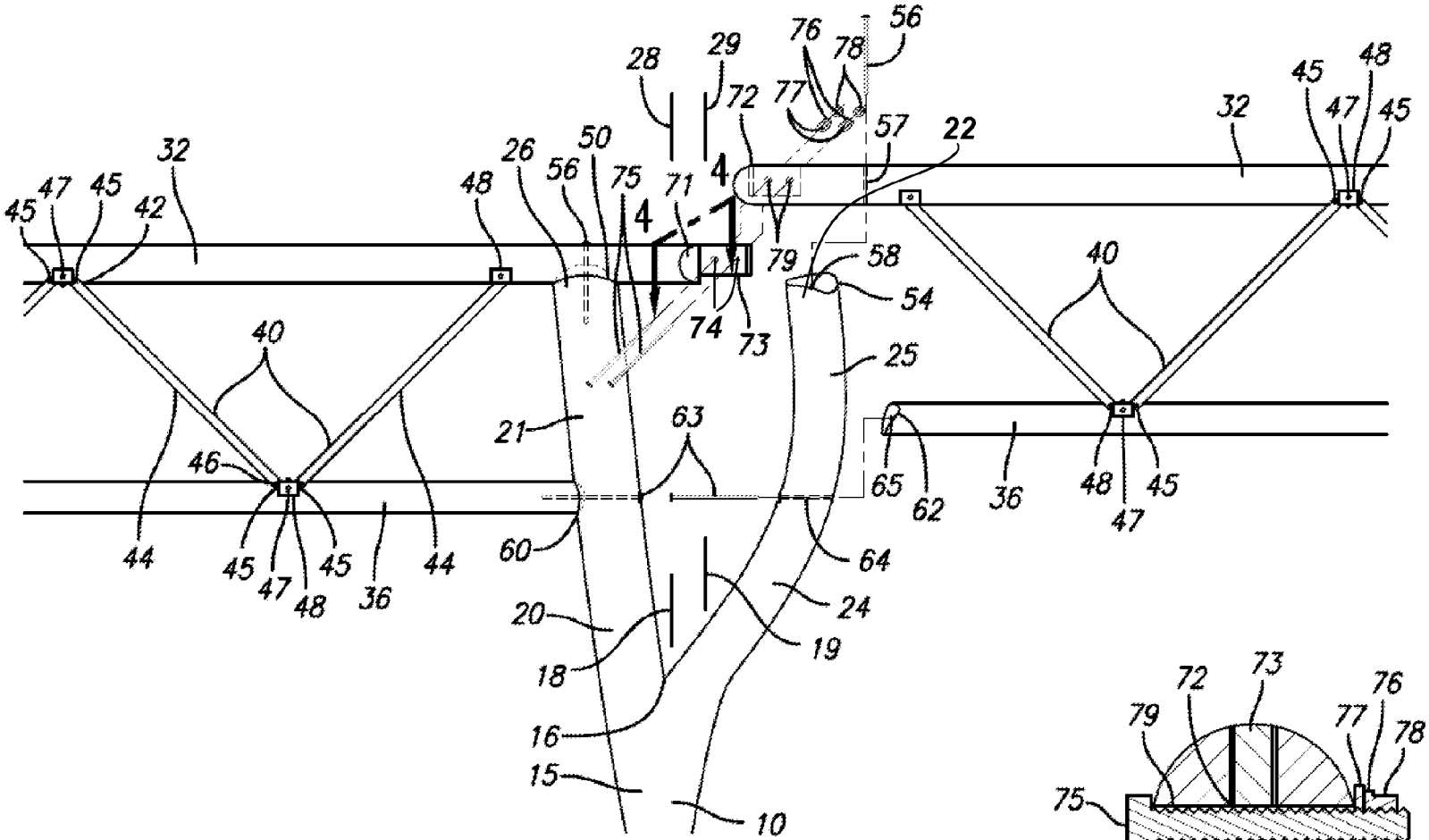
FIG. 2 is a first embodiment of a branched-timber-to-truss connection for use in the structure of FIG. 1.
Figure 4:
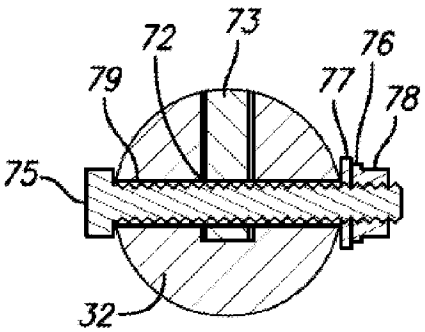
FIG. 4 is a cross-sectional view of the top-cord-to-top-cord connection in the truss and column assembly of FIG. 2, taken along the line 4-4 thereof.
Figure 3:
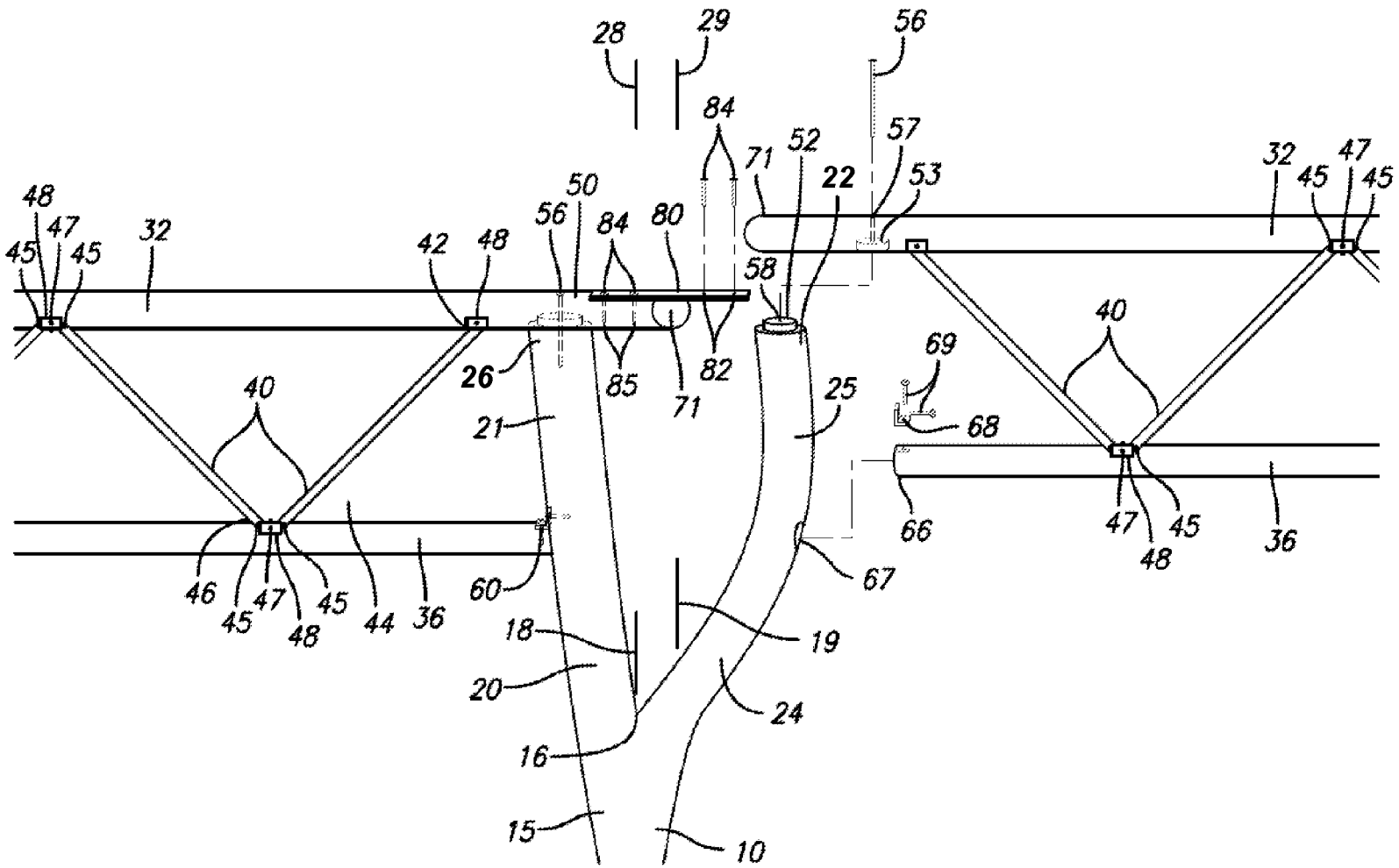
FIG. 3 is a second embodiment of a branched-timber-to-truss connection for use in the structure of FIG. 1.

As shown in FIGS. 2 and 3, the top-cord-to-branch-connection 50 may be formed using fasteners, such as screws 56 to fasten the top cord 32 to the first branch end 22 and second branch end 26. The top cord 32 can include a cord hole 57, at least as large in diameter as the screw 56. The first branch end 22 and second branch end 26 can each include a branch hole 58, preferably sized as a pilot hole for the screw 56. A flat washer can also be used, and the cord hole 57 can be countersunk to hide the hardware.

In the embodiment of FIG. 2, the first branch end 22 and second branch end 26 each include a branch saddle 54 shaped and dimensioned to conform to the circumference of top cord 32, so as to snugly receive the top cord 32 in the top-cord-to-branch-connection 50. In the embodiment of FIG. 3, the top-cord-to-branch-connection 50 includes a branch peg 52 at each branch end 52, the branch peg being shaped and dimensioned to fit a cord socket 53 cut into the underside of top cord 32.

In the embodiment of FIG. 2, the cord-cord connection 70 is formed using a plate 73 to join the top cord ends 34. In that embodiment, each top cord end 34 terminates in a cord flat face 71 cut at a right angle with respect to the longitudinal axis of the cord. Each top cord end 34 includes a slot 72 shaped and dimensioned to receive the plate 73. The plate 73 includes plate holes 74, and the top cord includes cord holes 79, all shaped and dimensioned to receive a fastener, such as bolt 75, which may be a lag bolt. Along with the bolt 75, a lock washer 76, washer 77, and nut 78 can be used to fasten the plate 73 and top cord ends 34 together. The cord holes 79 can be countersunk to hide the hardware, and flat washers can be used.

Plate 73 can be recessed into top cord 32 by scribing the parameters of plate 73 onto the surface of top cord 32 to determine an appropriate kerf, or slot, size and bolt hole locations. A kerf can then be cut into the surface of top cord 32 at top cord ends 34 to provide slot 72. The kerf should be cut longitudinally with the grain of the wood, and should be slightly larger than the length, width and thickness of plate 73. Bolt holes in alignment with holes in plate 73 are then drilled into top cord 32 and the plate is then inserted into the kerf, aligned with the holes and bolted across top cord ends 34.

In the embodiment of FIG. 3, the cord-cord connection 70 is formed using a strap 80. The strap 80 includes strap holes 82 shaped and dimensioned to receive fasteners, such as screws 84, to fasten the strap 80 and top cord 32 together.

In the embodiment of FIG. 2, the bottom cord/timber connection 60 is formed using fasteners, such as screws 63, to fasten the bottom cord 36 to the first branch 20 and second branch 24. The first branch 20 and second branch 24 each include a timber hole 64, at least as large in diameter as the screw 63. The ends of the bottom cord 36 each may include a cord hole 65, preferably sized as a pilot hole for the screw 63. In the embodiment of FIG. 2, each end of each bottom cord includes a cord saddle 62 shaped and dimensioned to snugly receive the branch. The timber holes 64 can be countersunk to hide the hardware, and flat washers can be used.

In the embodiment of FIG. 3, the bottom cord/timber connection 60 is formed using angle iron 68 and screws 69. The ends of the bottom cord each include a cord flat face 66 shaped and dimensioned to fit snugly in a timber flat surface 67 milled or otherwise formed on the surface of the branch.

Figure 5:
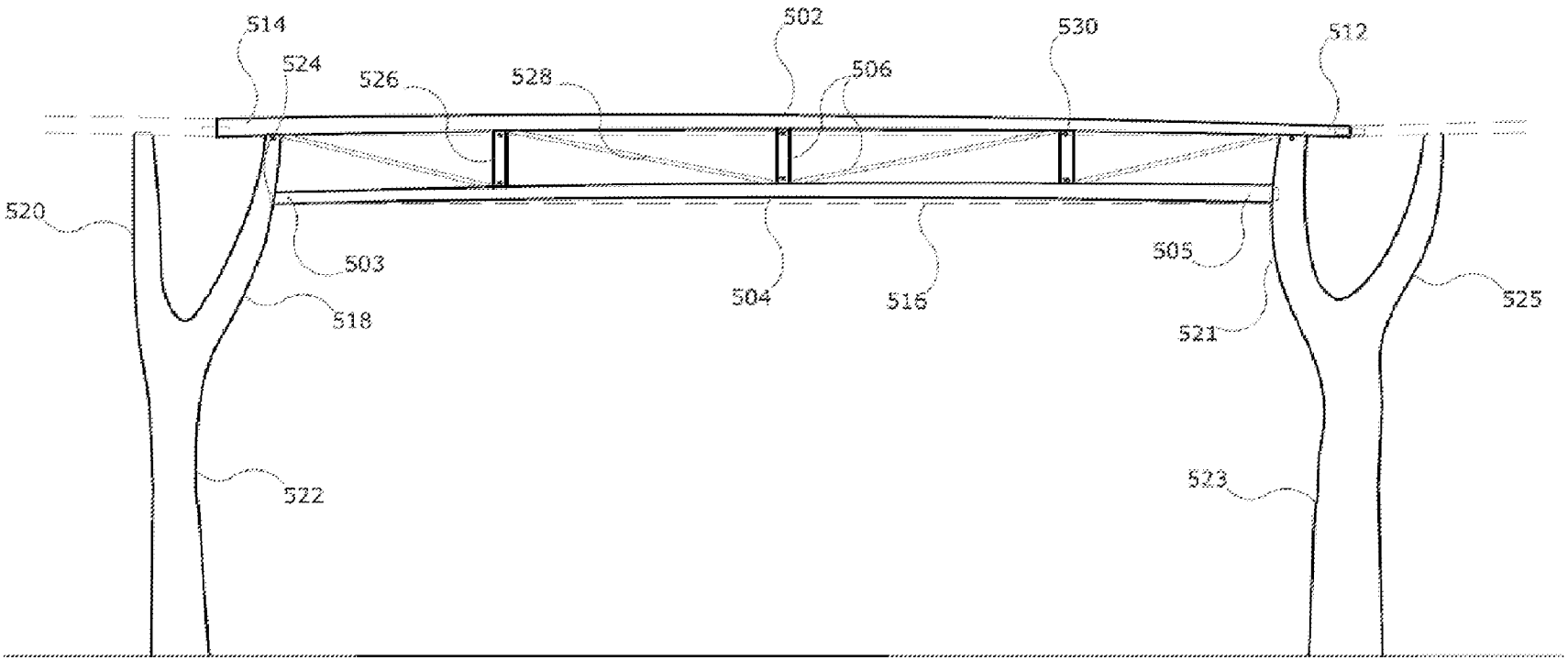
FIG. 5 depicts a truss and column assembly having two parallel truss cords comprised of natural round timbers, a truss web connected between the two cords, and two branched round timber columns.

Another embodiment of a truss and column assembly is shown in the schematic diagram of FIG. 5. Although this assembly can employ natural branched round timber columns of the type described above, using connections such as those described above, this assembly and the other truss and column assemblies described herein can also employ more conventional columns, including unbranched natural round timber columns and columns comprising lumber or metal beams. As shown in FIG. 5, the truss comprises a top cord 502 comprising a natural round timber and a bottom cord 504 comprising a natural round timber, the top and bottom cords being aligned in a substantially parallel arrangement. The truss further comprises a truss web 506 comprising a plurality of web members connected between top cord 502 and bottom cord 504.

Web members of truss web 506 include vertical members 526 and diagonal members 528, connected at regular intervals between top cord 502 and bottom cord 504. The diagonal and vertical members have an alternating arrangement, that is, an arrangement in which a vertical member is disposed between diagonal members. In some embodiments of the truss, the web members are comprised of natural round timbers, steel, milled timbers or a combination thereof. For example, vertical members 526 may be wood members comprising natural round timbers or lumber and diagonal members 528 may be steel members. The specific material, number, spacing and angles (relative orientations) of web members 526, 528 can be selected based on the specific spans, loads and other structural engineering requirements for the building structure into which the truss is to be incorporated. Advantageously, the truss design incorporating natural round timbers as cords reduces the number of web members and connecting points needed to resist loads relative to trusses having the same overall design that use steel or lumber cords. This can reduce the fabrication costs and can be attributed to natural round timber's larger section modulus, relative to common steel or milled lumber sections, which allows for increased spans between the bracing web members.

Top cord 502 and bottom cord 504 comprise long, straight natural round timbers with slight natural tapers along their lengths. The natural round timbers are desirably characterized by four or fewer growth rings per inch, particularly in the outer third of their radii. Such natural round timbers may be obtained, for example, from over-stocked tree stands where growth has been suppressed. Typical lengths for the natural round timbers are in the range from 20 to 50 feet and typical diameters for the natural round timbers are in the range from 3 to 14 inches (3" to 14"). However, lengths and diameters outside these ranges can be used. The natural round timbers are desirably not cut from tree tops with juvenile growth and should be visually inspected to avoid timbers with rot, insect infestations or a high density of knots. Selected natural round timbers can be peeled and dried (for example, to an average of 15% moisture content or lower). Once peeled and dried the natural round timbers can be inspected for twisting, checks and other defects and then tested in a machine stress grader for grading scores.

The natural round timbers from which top cord 502 and bottom cord 504 are constructed should have similar lengths and diameters and should be oriented with their tapers reversed, such that the thick end 514 of one natural round timber is above or below the thin end 512 of the other natural round timber. The natural round timbers have a natural curve, or camber, along their longitudinal axis. The trusses can be constructed such that both cord cambers are oriented upward, as shown in FIG. 5, and subsequently bent or straightened to the desired degree of curvature under an applied load when the truss is installed in a building structure. This straightening is illustrated by dashed line 516 in FIG. 5. One end 503 of bottom cord 504 is connected to one of two (or more) branches 518, 520 of a first branched natural timber 522, while the opposing end 505 of bottom cord 504 is connected to one of two (or more) branches 521, 525 of a second branched natural round timber 523. The connections can be made, for example, using a hanger 524 designed to resist axial and lateral loads, such that top cord 502 and bottom cord 504 combine to provide gravity and shear load resistance. In the present truss design, thin end 512 of top cord 502 may be insufficient to resist these loads alone. However, this is remedied by the bottom cord's connection in bearing. In addition, natural branched round timber columns eliminate the need for a vertical web at the end to transfer these axial and shear loads. In these respects, the truss can be distinguished from parallel trusses that use steel cord, in which the top cord alone suffices to resist loads.

As illustrated in FIG. 5, top cord 502 may be comprised of a plurality of natural round timbers disposed and connected in an end-to-end configuration. For clarity, the central natural round timber of top cord 502 is shown in solid lines, while the two additional natural round timbers from which top cord 502 is comprised are shown in dashed lines. Although not shown in FIG. 5, bottom cord 504 may also comprise a plurality of natural round timbers, connected across from one another on opposite sides of the crooks in the natural branched round timbers that provide the columns in the truss and column assemblies.

Figure 6:
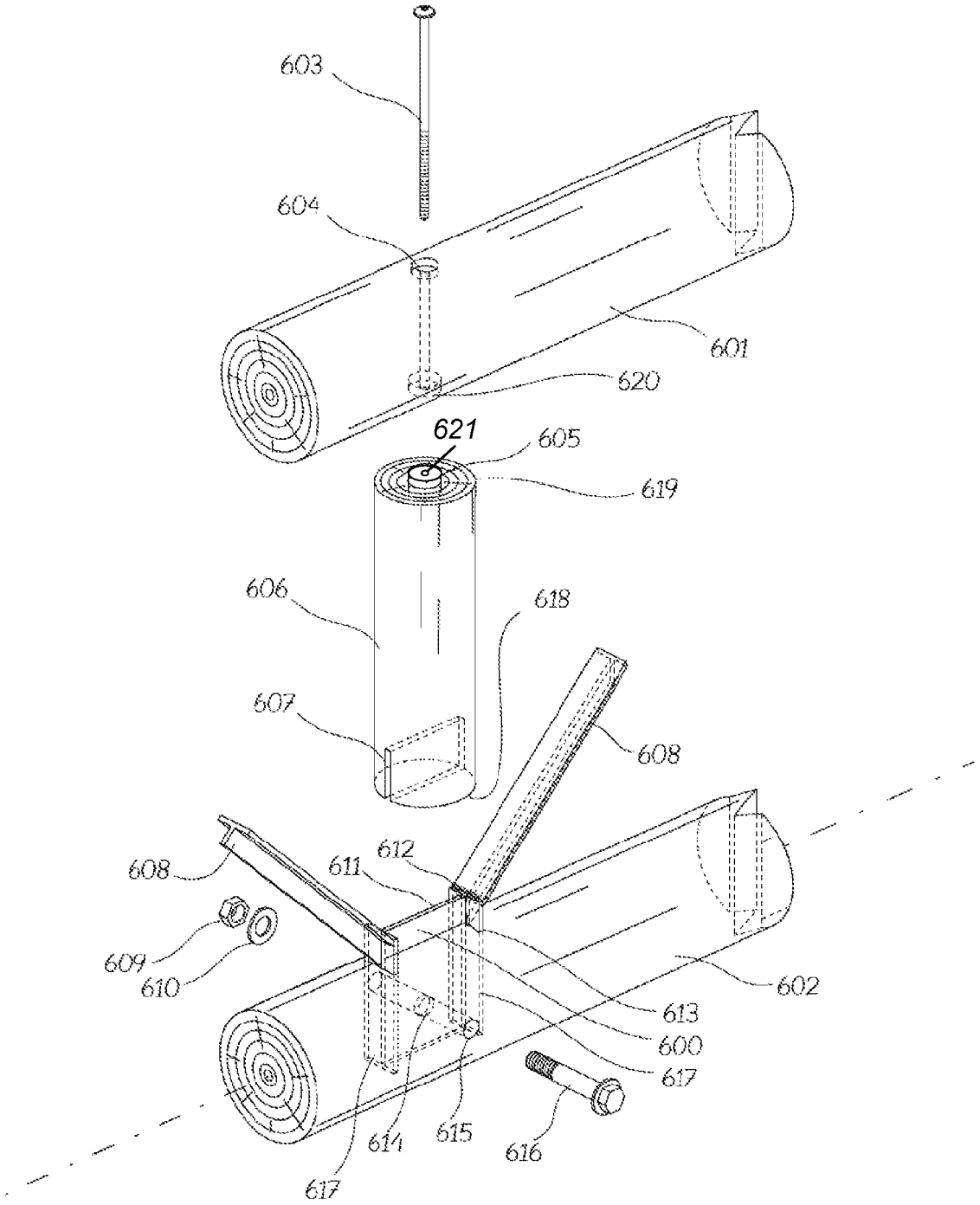
FIG. 6 depicts a connection between the web members and the bottom cord of the truss shown in FIG. 5.

FIG. 6 is a schematic diagram showing an axonimetric view of an embodiment of a web-to-cord connection that can be used in the truss such as that shown in FIG. 5. The connection includes a connection plate 600 that is inserted into a slot 613 in bottom cord 602, such that a lower portion of connection plate 600 extends into the bottom cord and an upper portion of connection plate 600 extends out of bottom cord 602. Slot 613 is configured to receive connection plate 600. (For clarity, the portion of connection plate 600 that extends into the slot in bottom cord 602 is shown in dashed lines.) Connection plate 600 can be fastened to bottom cord 602 by providing one or more plate holes 614 and one or more cord holes 615, wherein the plate holes and cord holes are configured such that they are in alignment when connection plate 600 is inserted into bottom cord 602. A fastener, such as a bolt 616, screw or nail, is then inserted into cord hole 615 and plate hole 614. Bolt 616 can be secured with a washer 610 and nut 609. In the embodiment depicted in FIG. 6, connection plate 600 comprises flanges 617 disposed along the opposing sides of a central member 611, such that it has an I-shaped cross-section along its length. This is advantageous because the flanges serve to increase the resisting area perpendicular to the lateral forces between the top and bottom cords and the web. A section of I-beam may be used to provide a connection plate having this geometry. Diagonal web members 608 are connected to the top sections of flanges 617 at their outer surfaces by, for example, welding or bolting them to said flanges. As shown in the figure, a joint 612 connects flange 617 to diagonal web member 608 at an angle. The vertical web members 606 comprise a slot 607 extending into one end 618 of the web member and configured to receive central member 611 of connection plate 600. The opposite end 619 of vertical web member 606 includes an extension 605. A notch 620 in top cord 601 is configured to receive extension 605. Top cord 601 further comprises a top cord hole 604 configured to received a fastener, such as a bolt 603, that extends through top cord hole 604 and into a fastener hole 621 in extension 605. Although, in the embodiment shown here, vertical web member 614 is a natural round timber, other materials, such as milled timber or steel, may be used.

It is understood that the invention is not confined to the embodiments set forth herein as illustrative, but embraces all such forms thereof that come within the scope of claims supported by this disclosure.

What is claimed is:

1. A truss comprising:

a top cord comprising a first natural round timber;

a bottom cord comprising a second natural round timber, the first natural round timber and the second natural round timber being disposed in a substantially parallel arrangement; and a webbing structure comprising a plurality of web members, the web members connecting the first natural round timber and the second natural round timber, wherein the web members comprise a plurality of diagonal members and a plurality of vertical members, the diagonal members and the vertical members having an alternating arrangement, and further wherein the vertical members comprise natural round timbers, wherein the diagonal members are steel members, the truss comprising a web-to-cord connection that connects the second natural round timber to a vertical member and two diagonal members, the web-to-cord connection comprising:

a connection plate comprising a central member, a first flange disposed along one side of the central member and a second flange disposed along the opposite side of the central member, wherein a lower portion of the connection plate extends into the second natural round timber and an upper portion of the connection plate extends out of the second natural round timber; and a fastener connecting the lower portion of the connection plate to the second natural round timber;

wherein:

one of the two diagonal members is connected to the first flange of the connection plate and the other diagonal member is connected to the second flange of the connection plate; and the lower end of the vertical member comprises a slot into which the central member of the connection plate extends.

2. A column-truss assembly comprising:

a first column;

a second column; and a truss connecting the first and second columns, the truss comprising:

a top cord comprising a first natural round timber;

a bottom cord comprising a second natural round timber, the first natural round timber and the second natural round timber being disposed in a substantially parallel arrangement; and a webbing structure comprising a plurality of web members, the web members connecting the first natural round timber and the second natural round timber, wherein the web members comprise a plurality of diagonal members and a plurality of vertical members, the diagonal members and the vertical members having an alternating arrangement, and further wherein the vertical members comprise natural round timbers, wherein the diagonal members are steel members, the assembly comprising a web-to-cord connection that connects the bottom cord to a vertical member and two diagonal members, the web-to-cord connection comprising:

a connection plate comprising a central member, a first flange disposed along one side of the central member and a second flange disposed along the opposite side of the central member, wherein a lower portion of the connection plate extends into the second natural round timber and an upper portion of the connection plate extends out of the second natural round timber; and a fastener connecting the lower portion of the connection plate to the second natural round timber;

wherein:

one of the two diagonal members is connected to the first flange of the connection plate and the other diagonal member is connected to the second flange of the connection plate; and the lower end of the vertical member comprises a slot into which the central member of the connection plate extends.

3. A column-truss assembly comprising:

a first column;

a second column; and a truss connecting the first and second columns, the truss comprising:

a top cord comprising a first natural round timber;

a bottom cord comprising a second natural round timber, the first natural round timber and the second natural round timber being disposed in a substantially parallel arrangement; and a webbing structure comprising a plurality of web members, the web members connecting the first natural round timber and the second natural round timber;

wherein the web members comprise a plurality of diagonal members and further wherein the assembly comprises a web-to-cord connection that connects the bottom cord to a first diagonal member and a second diagonal member, the web-to-cord connection comprising a connection plate comprising a central member, a first flange disposed along one side of the central member and a second flange disposed along the opposite side of the central member, wherein the connection plate is inserted into the bottom cord and further wherein the first diagonal member is connected to the first flange of the connection plate and the second diagonal member is connected to the second flange of the connection plate;

wherein the connection plate has an I-shaped cross-section along its length.

4. The assembly of claim 3, wherein the first and second diagonal members are steel members.

5. The assembly of claim 3, wherein the first and second diagonal members are wood members.

* * * * *